United States Patent [19]

Hughes

[11] 4,419,979

[45] Dec. 13, 1983

[54] DRESSING AND FORMING OF GRINDING WHEELS

[75] Inventor: Robert B. Hughes, Isando, South Africa

[73] Assignee: Boart International, Ltd., Johannesburg, South Africa

[21] Appl. No.: 244,308

[22] Filed: Mar. 16, 1981

[30] Foreign Application Priority Data

Mar. 19, 1980 [ZA] South Africa ..... 80/1581

[51] Int. Cl.[3] ..... B24B 53/12

[52] U.S. Cl. ..... 125/11 R; 125/39

[58] Field of Search ..... 125/11 R, 39

[56] References Cited

U.S. PATENT DOCUMENTS

| | | | |
|---|---|---|---|
| 2,144,901 | 1/1939 | Stopp | 125/39 |
| 2,367,857 | 1/1945 | Findlater | 125/39 |
| 2,421,926 | 6/1947 | Corouel | 125/39 |
| 2,587,132 | 2/1952 | Finke | 125/39 |
| 2,860,623 | 11/1958 | Muench | 125/39 |
| 2,890,694 | 6/1959 | Miller | 125/39 |
| 3,898,772 | 8/1975 | Sawluk | 125/39 |
| 4,285,324 | 8/1981 | Komanduri | 125/39 |
| 4,339,896 | 7/1982 | Dennis et al. . | |

FOREIGN PATENT DOCUMENTS

| | | |
|---|---|---|
| 2052344 | of 0000 | Fed. Rep. of Germany . |
| 2825852 | of 0000 | Fed. Rep. of Germany . |
| 7245865 | of 0000 | Fed. Rep. of Germany . |
| 8014412 | of 0000 | Fed. Rep. of Germany . |

OTHER PUBLICATIONS p. 265 "Mechanical Engineering" edited by K. T. Chang, published by San Wen Publishing Co.

Tool Catalog-Taiwan Diamond Industrial Co. Ltd.

*Primary Examiner*—Harold D. Whitehead

*Attorney, Agent, or Firm*—Lowe, King, Price & Becker

[57] ABSTRACT

A dressing tool for grinding wheels has a hard material insert preferably of syndite, with a cutting edge, projecting forwardly from a holder. Shoulders are formed adjacent the insert by the forward, flat face of the holder. The insert is chisel-shaped. The ratio of the length of the exposed part of the insert to the lateral width of each shoulder may be at least 1:4, and the two lengths may be substantially equal.

6 Claims, 6 Drawing Figures

DRESSING AND FORMING OF GRINDING WHEELS

FIELD OF THE INVENTION

This invention lies in the field of the dressing of grinding wheels. As the use for which the invention was devised is for form dressing of wheels, this specification will deal primarily with that aspect, but it must be understood that it is applicable also to the dressing of unprofiled wheels such as in ordinary wheel dressings, and to the production of profiled wheels.

BACKGROUND OF THE INVENTION

Conventionally, grinding wheels are dressed by means of a tool in which a diamond is mounted in a holder and is presented to the wheel. These tools have notorious difficulties and pose problems both to the toolmaker and to the user. For one thing, diamonds contain hardness vectors (or grain) which must be identified by the toolmaker when he is mounting the diamond in its holder. For another thing, where the tool can be used in more than one orientation (by reason, for instance, of a cylindrical holder clamped in a complemental toolpost) the tool must be marked for correct orientation in the post.

Neglect by either toolmaker or user results in materially shorter life, and, as diamonds are expensive commodities, this is a serious consideration. There is the further aspect that, not only are diamonds expensive, but their availability is decreasing, and this is especially so in that, under current market conditions, maccle shapes, that is the flat trianguloid shape most suited for form dressing, are increasingly being diverted for use as gemstones.

Finally, the polished or shaped diamond must be so mounted as to be supported everywhere save at the exposed face which does the dressing, to bond the diamond mechanically to its support.

To avoid, or at least minimise, these disadvantages, it has been proposed to substitute the diamond stones by inserts of ultra hard material such a specialised compacts of diamond grit in a metal matrix, or ceramic materials. While the problems of orientation are avoided, the cutting element however is still fully supported. The tool is chisel shaped, with the central zone performing the dressing operation.

Traditionally the tool uses a diamond and the dressing operation has been a process which removes the unwanted material by crushing.

This process, which causes the projecting particle surfaces in the wheel to be crushed, has unhappy consequences. The friction generated between the tool and the wheel raises the temperature of the wheel and the tool undesirably. The increase in temperature causes the wheel diameter to expand, alters the datum position of the dresser and carbonizes the diamond. The crushing of the surface particles tends to leave too smooth a surface, creating fine dust which, in the interest of health, must be exhausted, and clogging of the wheel face. As some force has to be applied to the tool to cause the crushing action, holders, tool post, and tracing arms tend to be deflected, and thus must be correspondingly robust to resist deflection.

The object of the present invention is to provide a dressing method and a dressing tool which minimises still further the disadvantages of diamond tools, and which has substantial benefits over such tools.

THE INVENTION

According to the invention, a dressing tool consists of a holder , a triangular-prismatic ultra hard material insert in and projecting forwardly from the holder to provide a cutting formation, the holder being shaped to form a shoulder between it and the side of the insert.

Hard material refers generally to refractory metal carbides bonded with a metal of the iron triad of the Periodic Table, or other refractory boride, silicide, or nitride, and to ultra hard materials such as diamond dispersed in a metal or ceramic matrix.

In the preferred form, the tool is symmetrical relative to its longitudinal axis, to provide a shoulder on each side of the insert. The ratio of the length of the exposed part of the insert to the lateral extent of each shoulder may be at least 1:4 and preferably is in the region of 1:1 i.e. the two dimensions are substantially equal. In the prior art diamond tool this ratio is far lower. The insert is thus exposed to a greater extent than the diamond in the prior art.

The invention consists also in the use of a tool as described above, mounted for the cutting formation to be on the horizontal plane containing the centre of the wheel, when the periphery of the wheel is being dressed.

When the side face of the wheel is dressed the tool may be inclined or tilted to the face, at an angle in the region of 5° from the normal, i.e. with a negative slope with respect to the direction of wheel rotation.

The insert may be mounted in any suitable manner e.g. by mechanical clamping but preferably is mounted by being brazed in position. Mechanical clamping permits ready use of an indexible insert.

THE DRAWINGS

An embodiment of the invention is seen in the accompanying drawings, in which:

FIG. 1 is a side view of the tool, FIG. 2 is another side view at right angles to the view of FIG. 1, FIG. 3 is an end view of the tool, FIG. 4 is a perspective view, on an enlarged scale, of the end of the tool, and, FIGS. 5 and 6 are side views of the tool in use.

DESCRIPTION OF THE DRAWINGS

In the drawings, the body of the tool is numbered 10. The cutting formation 12 is a triangular-prismatic insert that is mounted within the body (e.g. by brazing) and projects forwardly from it. The body is formed with a tapering end 14 that is co-planar with the sides of the chisel-shaped insert, or is so formed after the insert has been inserted into it. The forward end of the body is shaped to provide a flat shoulder 16 on each side of the insert, and may be chamfered at 18 and 20. The insert is symmetrically mounted on the holder and the projection of the insert beyond the shoulders 16 in this example is substantially equal to the width s (FIG. 1) of each shoulder.

The shape of body 10 is cylindrical in the drawing, but, of course, it may be of any required shape or size to fit a complemental tool post. The shape of insert 12 is shown as triangular-prismatic, in that the forward, cutting end 22 is straight, but it may, if so needed, be arcuate or even terminate in a point.

Formation 12, as discussed above, is of ultra hard material. A preferred material is commercially known as "Syndite" which is a synthesised, extremely tough, intergrown mass of randomly orientated diamond particles in a metal matrix, produced by sintering selected diamond particles at high temperatures and pressures. Sintering takes place within the diamond-stable region of diamond-graphite.

Insert 12 is secured within body 10 by any suitable means, however, one advantage offered by the invention is that it can be brazed in place. Syndite, which in itself is not readily wettable, comes in a triangular-prismatic form secured to a hard metal backing. This backing is wettable and can be brazed in position.

Figure 5:
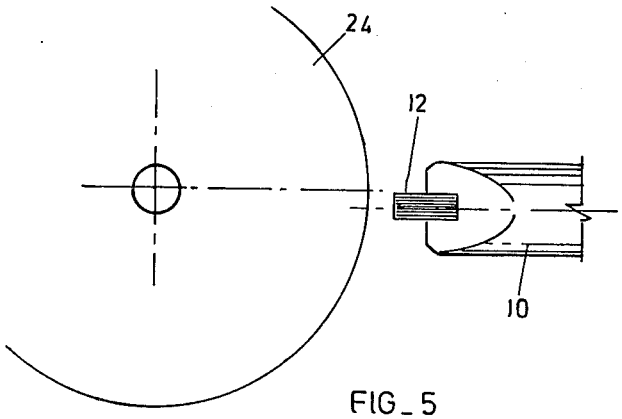

FIG. 5 illustrates the use of the tool of the invention for dressing the periphery of a wheel 24. The cutting formation is located in the tool post to be central to wheel 24 or slightly below it, as in lathe practice. This is important because the process of dressing with the tool of the invention is a cutting operation whereas the dressing process has hitherto been an abrading or crushing operation. The consequence is that there is greatly reduced friction between the tool and the wheel, with lower temperature rise; dressing forces are much reduced with corresponding lowering of deflecting forces on the post and related structure; there is considerably less generation of dust, and less clogging of the wheel with detritus. This latter benefit produces a dressed wheel which cuts more freely than the conventionally dressed wheel and thus holds its size longer. Dresser tool life is therefore increased.

Figure 1:
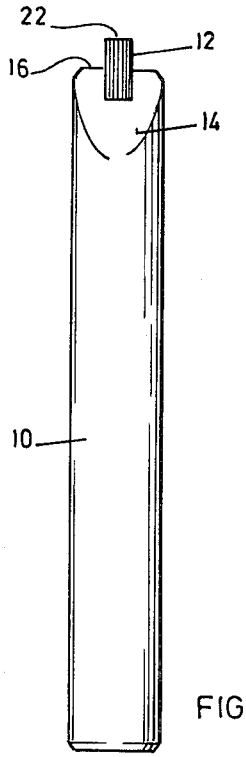
Figure 2:
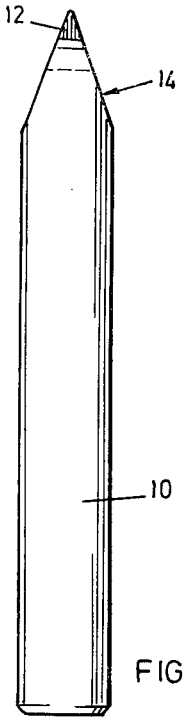
Figure 3:
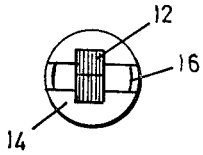
Figure 6:
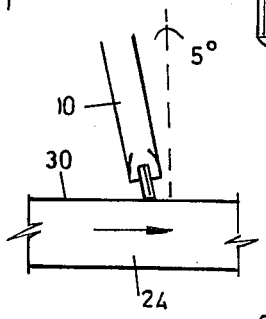
Figure 4:
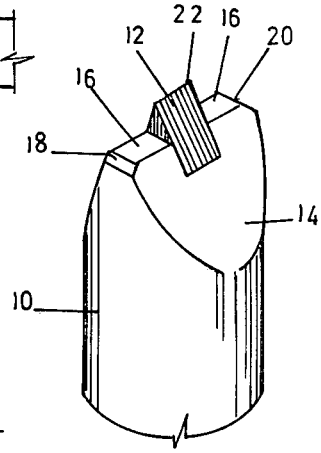

FIG. 6 shows the tool of the invention dressing side face 30 of wheel 24. The tool is inclined to the face at a negative angle in the region of 5° to the normal, although this angle can vary in practice according to requirement.

Comparative tests have been conducted with the dressing tool of the invention, and diamond dressing tools.

TEST 1

A wheel of WA-100G-V 8"×¾"×1¼" was dressed using the tool of the invention.

A pass of 0.010" depth across the periphery of the wheel was taken and this was repeated 10 times making 0.2" removed from the diameter of the wheel.

No noticeable wear was displayed on the tool.

The next trial was to dress a convex radius on the corner of the wheel and this was set at 0.150".

Dressing with a normal diamond would have been achieved by 0.001" per pass, but with the tool of the invention 3 passes of 0.050" depth were made and no wear on the tool was noticeable. With a conventional tool 150 passes of 0.001" per pass would have been required.

TEST 2

Using a tool according to the invention an 8" diameter ×¾" wide MA46-J-V wheel was dressed removing approximately 0.31" on diameter, with cut depths of 0.0125" per pass. The cut depth of a conventional diamond tool would be 0.001" per pass. The dressing was carried out using a P. G. Optidress attachment with the centralising stops up and dressing the straight peripheral face of the wheel in a most brutal manner.

With the dressing tool still mounted in the Optidress there was no visible wear by means of optical examination. When the tool was removed however, a certain amount of wear could be seen on the cutting edge. This was not apparent whilst in the Optidress radius arm, as the dressing tool is presented at a neqative angle of approximately 5°, (see FIG. 6) and the 60°×0.010" radius tool of the invention still looked perfect. The dressing of this wheel in this manner would have consumed a number of standard conical diamonds. A 60°×0.010" radius ordinary chisel diamond would have been completely ruined.

This test confirmed that the tool of the invention is a far superior dressing tool to the standard 60° conical diamond tool or a tool of the maccle diamond chisel-type tool.

Another very important aspect of the process is the presence of the shoulder 16. Swarf produced during the cutting of the wheel impinges on the shoulder and falls from it, so that, not only is there less generation of dust because of the cutting operation, but what dust there is tends not to enter the ambient atmosphere.

Another benefit of the tool of the invention is that the problem of orientation of the cutting element in diamond dressers is entirely eliminated as the toolmaker is free of the problem. The only orientation needed is in the hands of the user, to ensure that the chisel end of the tool is set to the settings previously described in connection with FIGS. 5 and 6, viz. normal at the periphery (zero neutral on the leading edge) or at a negative angle of about 5° when dressing the side face.

And finally, it is pointed out that the life of the tool is doubled by reason of the symmetrical mounting of the insert in the holder i.e. the tool is indexible through 180° presenting an identical second cutting edge.

The invention includes also a method of wheel dressing, which consists in mounting a tool according to the invention in juxtaposition to the wheel to be dressed, with the cutting formation of the tool at or slightly below centre, and feeding the tool into the wheel to skim or cut it.

The conversion of the dressing operation from grinding to cutting means that the shaping of a profiled wheel is not only facilitated, but that the grinding of some profiled wheels which has hitherto been very difficult because of the numerous passes required can now easily be effected because, viewed in plan, the contact between the wheel and the cutting formation is a point contact, and is such that crushing, which occurs with a single point diamond tool, is avoided. It follows that, not only is the tool a valuable asset in dressing a wheel, but a profiled wheel of considerable complexity can be fabricated by using it to generate the designed profile i.e. the tool lends itself readily to the technique known as form wheel dressing.

The extent to which the insert extends from the shoulder depends in practice on the shape and size of the tool. If the tool is relatively large the ratio of the projection to the shoulder width will be comparatively low, say down to 1:4 but this ratio is still large compared to the ratio prevailing with a conventional diamond tool, typically 1:10. The protruding tip of the tool of the invention ensures that the cuttings are readily dispersed and are not entrained in the wheel i.e. the process is one of cutting rather than grinding or crushing.

A further point is that the negative angle subtended by the tool to the normal when skimming a side face of a wheel may vary from about 1° up to 10° but normally will be in the region of 5°.

The insert has been described as being preferably brazed in position. However mechanical clamping of the insert to the holder may be resorted to, particularly if this facilitates indexing of the insert.

I claim:

1. A dressing tool for dressing and forming of grinding wheels comprising a holder and a single triangular-prismatic hard material insert secured within and projecting forwardly from the holder to provide a cutting formation, said holder having a tapered end defining tapered surfaces aligned and coplanar with sides of said insert, said tapered end being further shaped to form shoulders on opposed sides of the insert, wherein a ratio of the length of a projecting exposed part of the insert to each shoulder length is at least 1:4, said material insert providing cutting action during wheel dressing and being a unitary body comprising a synthesized, intergrown mass of randomly oriented diamond particles sintered within a metal or ceramic matrix to provide first and second cutting edges being respectively engageable with a workpiece by indexing the tool approximately 180°.

2. A tool according to claim 1 wherein the length of projection of the exposed part of the insert is substantially equal to each shoulder length.

3. A tool according to claim 2 wherein said tapered forward end of the holder forms a pair of shoulders each being substantially flat.

4. A tool according to claim 1 wherein said insert is brazed to the holder.

5. A tool according to claim 1 wherein said insert is mechanically clamped to the holder.

6. A tool according to claim 1 wherein said shoulders respectively include chamfered edges.

* * * * *